US006951036B2

(12) United States Patent
Lemire

(10) Patent No.: US 6,951,036 B2
(45) Date of Patent: Oct. 4, 2005

(54) COLLAPSIBLE SIDERAIL ASSEMBLY

(75) Inventor: Guy Lemire, Beaumont (CA)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 10/767,650

(22) Filed: Jan. 29, 2004

(65) Prior Publication Data

US 2005/0166320 A1 Aug. 4, 2005

(51) Int. Cl.[7] ..... A47D 7/00; A47C 21/08
(52) U.S. Cl. ..... 5/425; 5/427; 5/430
(58) Field of Search ..... 5/425, 427, 430

(56) References Cited

U.S. PATENT DOCUMENTS

| | | | | |
|---|---|---|---|---|
| 359,879 | A * | 3/1887 | Miller | 5/425 |
| 2,817,855 | A | 12/1957 | Pratt | |
| 3,081,463 | A * | 3/1963 | Williams et al. | 5/430 |
| 3,585,659 | A * | 6/1971 | Burst et al. | 5/430 |
| 3,932,903 | A | 1/1976 | Adams et al. | |
| 4,186,456 | A | 2/1980 | Huempfner | |
| 4,747,171 | A | 5/1988 | Einsele et al. | |
| 4,985,946 | A * | 1/1991 | Foster et al. | 5/427 |
| 5,083,334 | A | 1/1992 | Huck et al. | |
| 5,926,870 | A | 7/1999 | Branca-Barnes et al. | |
| 6,360,385 | B1 | 3/2002 | Lewandowski | |
| 6,363,552 | B1 * | 4/2002 | Hornbach et al. | 5/425 |
| 6,691,345 | B2 * | 2/2004 | Nanahara | 5/430 |
| 2003/0093860 | A1 * | 5/2003 | Kramer et al. | 5/425 |

FOREIGN PATENT DOCUMENTS

| | | | | |
|---|---|---|---|---|
| EP | 428829 | * | 5/1991 | 5/430 |

* cited by examiner

*Primary Examiner*—Jong-Suk (James) Lee
(74) *Attorney, Agent, or Firm*—Flynn, Thiel, Boutell & Tanis, P.C.

(57) ABSTRACT

A siderail assembly for a bed which includes a frame having thereon at least one pivotally supported arm for movement between first and second positions, the arm having at a distal end thereof a first connection location. A siderail support frame is pivotally connected to the distal end of the arm and has thereon at least one upstanding and elongate guide member. A siderail carriage frame is supported for movement along a length of the guide member toward and away from the siderail support frame and has thereon at least one second connection location. An elongate link is pivotally connected to and extends between the first and second connection locations to effect movement of the siderail carriage frame along the guide member toward and away from the siderail support frame in response to a pivotal movement of the arm relative to the frame to change the spacing between the siderail carriage frame and the siderail support frame.

5 Claims, 15 Drawing Sheets

COLLAPSIBLE SIDERAIL ASSEMBLY

FIELD OF THE INVENTION

This invention relates to a siderail assembly for a bed and, more particularly, to a siderail assembly that is configured to expand in the top to bottom dimension thereof as the siderail transitions from a stowed position to a fully deployed position.

BACKGROUND OF THE INVENTION

Equipment for use in a patient care facility has been categorized in the past into constructions adapted for limited use. For example, hospital beds located within hospital rooms were ordinarily constructed so as to remain in the room and not be capable of easy transport to and from the room. As a result, it became necessary to transfer the patient from the hospital bed to a patient transport carrier for transporting the patient to a remote location for additional treatment, whereat the patient would likely need to be transferred to an additional supporting surface. It would be desirable to provide a patient supporting surface, namely, a hospital bed, that is usable both in the hospital room as well as usable for effecting transport of the patient from the room to a remote location for additional treatment, including surgery, while remaining supported on the patient supporting surface of, for example, the hospital bed.

In order to effect the safe transport of a patient on the patient supporting surface, it is necessary to provide a siderail mechanism on both lateral sides of the bed to prevent the patient from exiting the patient supporting surface either voluntarily or involuntarily. Since the patient will be experiencing additional healthcare treatment while positioned on the patient supporting surface, it is required that the siderail be retractable and removable to a position free of interference of the healthcare personnel providing the additional treatment to the patient. Simply collapsing the siderail from its initial deployed position wherein the handrail thereon is above a plane of the patient supporting surface to a position below the plane of the patient supporting surface is simply not enough. The siderail configuration will interfere with the close access required for the healthcare personnel to access the patient supported on the patient supporting surface. Further, as the siderail is moved from the fully deployed position to the stowed position, it would be desirable to provide a siderail that would collapse in the top to bottom dimension thereof so that the distance traveled by the siderail from the deployed position to the stowed position can be minimized to prevent interference with structure on the base of the bed.

Therefore, it is an object of this invention to provide a siderail construction for a patient supporting surface that is elevatable to a deployed position preventing voluntary or involuntary exit of the patient from the patient supporting surface while simultaneously being movable to a position providing free and unobstructed access to the patient supported on the patient supporting surface.

It is a further object of the invention to provide a siderail construction, as aforesaid, wherein the siderail itself is retractable to a position beneath the patient supporting surface enabling the healthcare attendant to move close to the lateral edge of the patient supporting surface for convenient access to the patient supported on the patient supporting surface.

It is a further object of the invention to provide a siderail construction, as aforesaid, wherein the top to bottom dimension of the siderail is variable as the siderail moves from the deployed position toward the stowed position and to thereby limit the overall vertical distance traveled by the siderail as it moves in the aforesaid direction.

It is a further object of the invention to provide a siderail construction, as aforesaid, wherein the operation of the siderail between its stowed position and its fully upright deployed position can be accomplished by the healthcare attendant through the use of only one hand.

It is a further object of the invention to provide a siderail construction, as aforesaid, which is of a durable construction and requires little or no maintenance.

It is a further object of the invention to provide a siderail construction, as aforesaid, which is easy to clean.

SUMMARY OF THE INVENTION

The objects and purposes of the invention are met by providing a siderail assembly for a bed which includes a frame having thereon at least one pivotally supported arm for movement between first and second positions, the arm having at a distal end thereof a first connection location. A siderail support frame is pivotally connected to the distal end of the arm and has thereon at least one upstanding and elongate guide member. A siderail carriage frame is supported for movement along a length of the guide member toward and away from the siderail support frame and has thereon at least one second connection location. An elongate link is pivotally connected to and extends between the first and second connection locations to effect movement of the siderail carriage frame along the guide member toward and away from the siderail support frame in response to a pivotal movement of the arm relative to the frame to change the spacing between the siderail carriage frame and the siderail support frame.

BRIEF DESCRIPTION OF THE DRAWINGS

Other objects and purposes of this invention will be apparent to persons acquainted with siderail apparatus of this general type upon reading the following specification and inspecting the accompanying drawings, in which.

DETAILED DESCRIPTION

Figure 1:
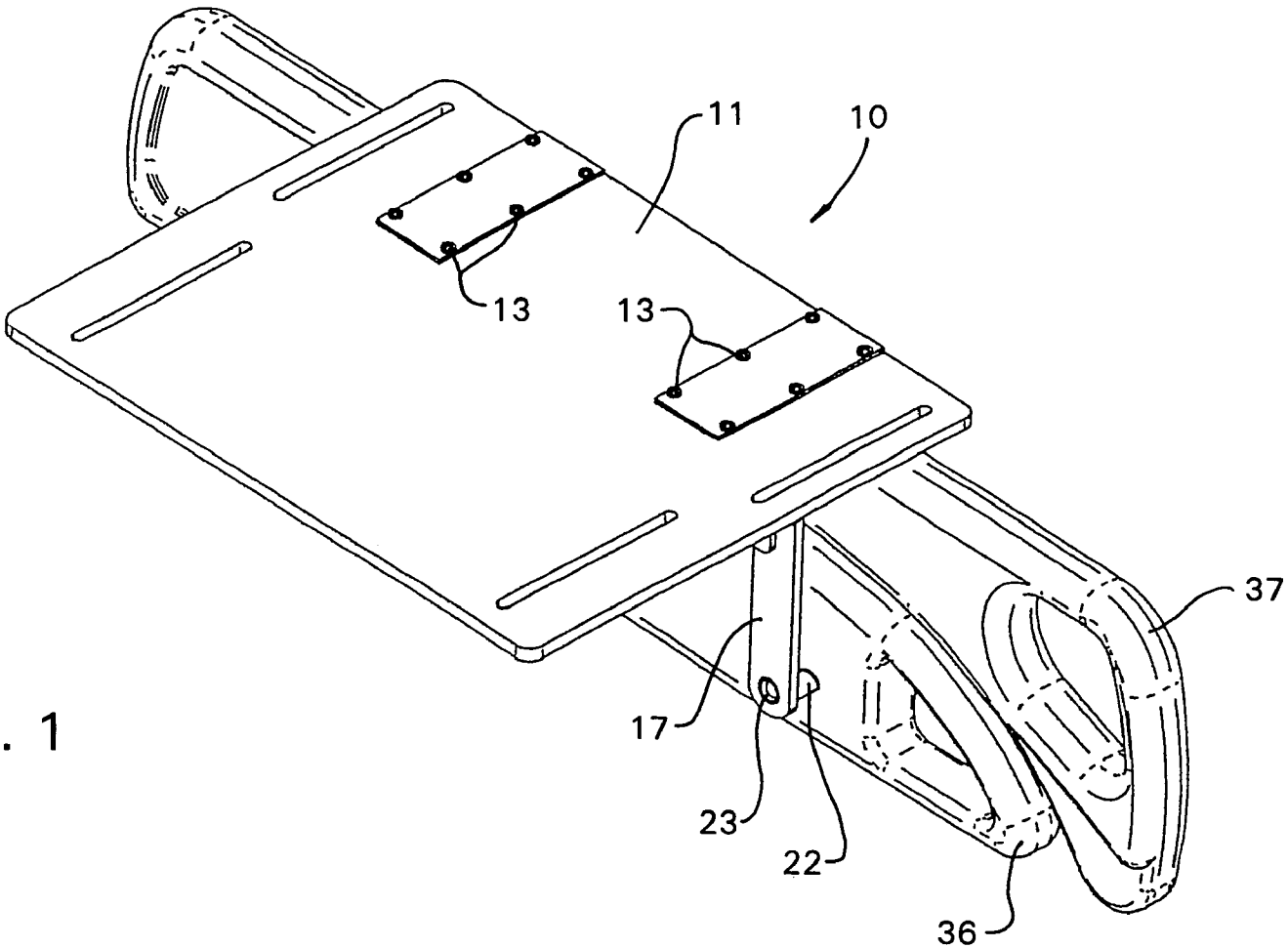
FIG. 1 is a top, rear and right side isometric view of a siderail assembly embodying the invention.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

The invention disclosed herein will be usable on a variety of patient support apparatuses, namely, beds. Thus, a specific bed is not illustrated. However, one typical type of patient support apparatus and a siderail configuration therefor is disclosed in U.S. Pat. No. 6,360,385 presently commonly owned by the Assignee of record for this invention. The subject matter of U.S. Pat. No. 6,360,385 is to be incorporated herein by reference.

Figure 2:
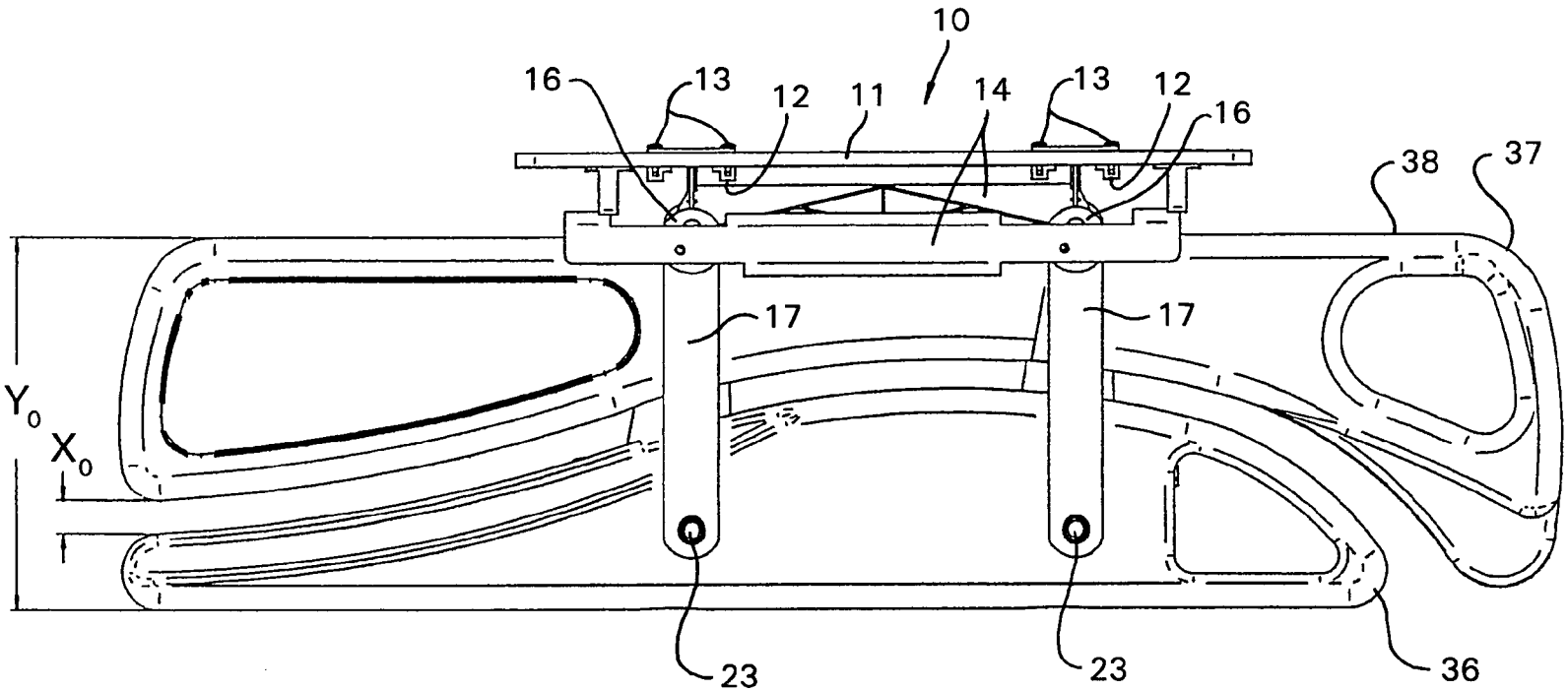
FIG. 2 is a rear view of the siderail assembly illustrated in FIG. 1.
Figure 3:
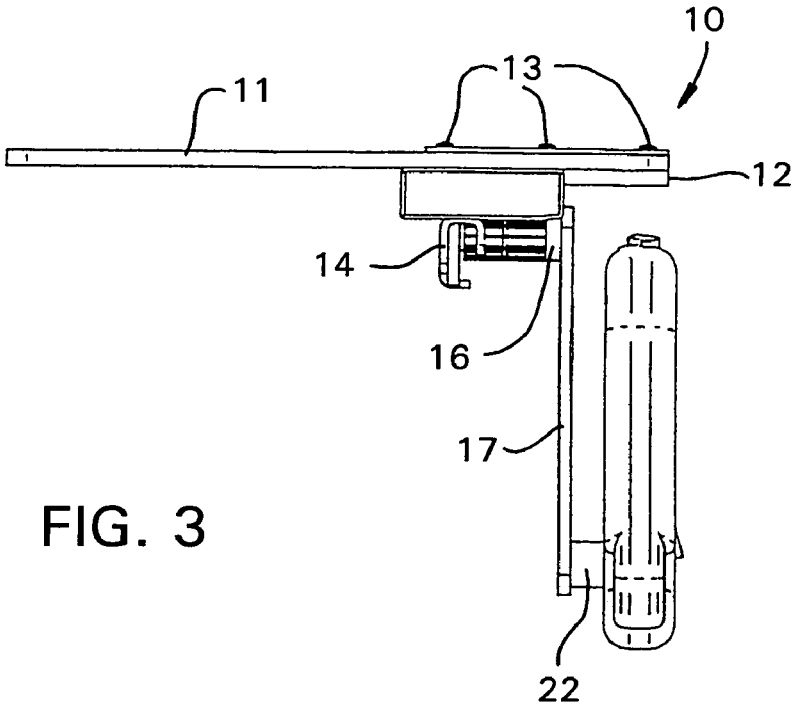
FIG. 3 is a right side elevational view of the assembly illustrated in FIG. 1.
Figure 4:
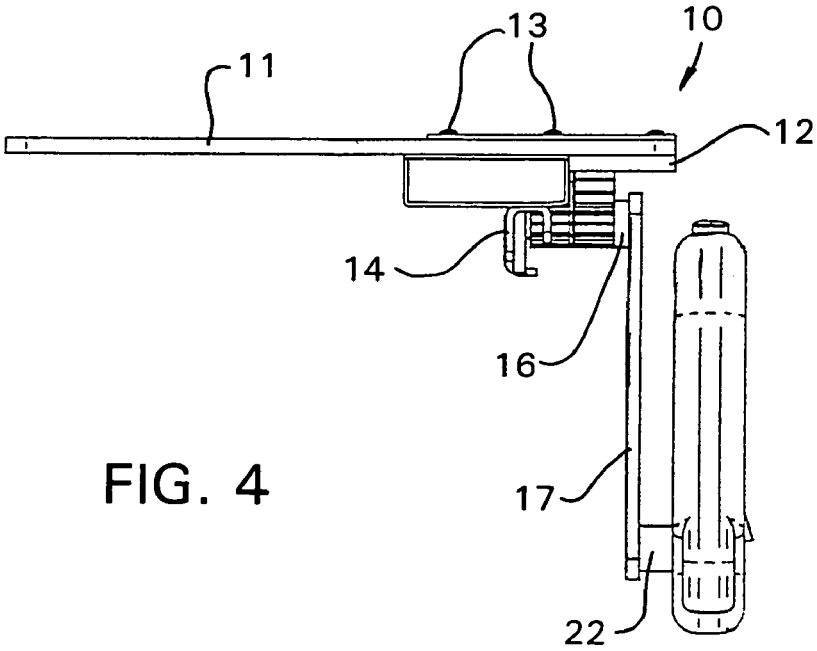
FIG. 4 is a right side view similar to FIG. 3, but with the siderail assembly shifted to the right.

FIG. 1 illustrates a siderail assembly 10 embodying the invention. The siderail assembly 10 includes a plate 11 configured to be mounted to the understructure supporting the patient support deck on a conventional patient support apparatus. The location of the plate 11 is preferably along the lateral edges of the understructure for the patient support deck associated with the head section and the seat section for the bed. At least one elongate and laterally extending track 12 (FIGS. 3 and 4) is secured to the underside of the plate 11 by a plurality of fasteners 13. A carriage 14 is supported for lengthwise movement on the track 12 between the positions illustrated in FIGS. 3, 4 and 5. If desired, plural longitudinally spaced tracks 12 can be secured to the underside of the plate 11 as is illustrated in FIG. 2. Each of the tracks 12 extends parallel to one another and are designed to terminate approximately flush with a vertical plane containing the lateral edge of the patient support deck. Further, and in this particular embodiment, the carriage 14 is guided by and extends between each of the plural tracks 12. The carriage 14 supports at least one journal 16 housing a bearing assembly (not illustrated) for pivotally supporting at least one elongate arm 17. In this particular embodiment, however, two such journals 16 are provided so that a pair of arms 17 are pivotally supported by respective ones thereof.

Figure 5:
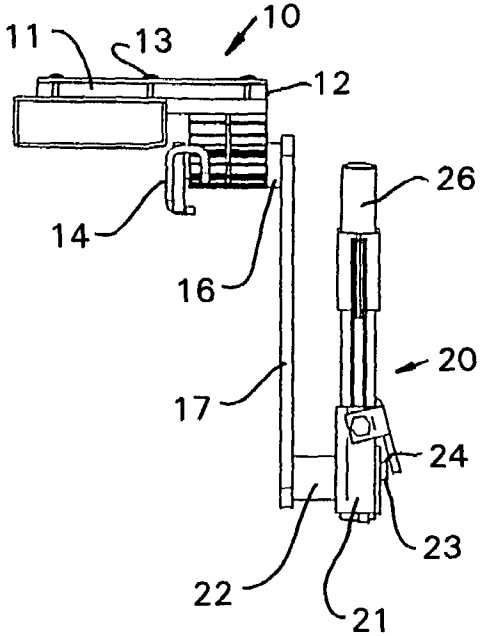
FIG. 5 is a right side view of the siderail assembly similar to FIG. 4, but with the siderail shroud on the siderail removed.
Figure 7:
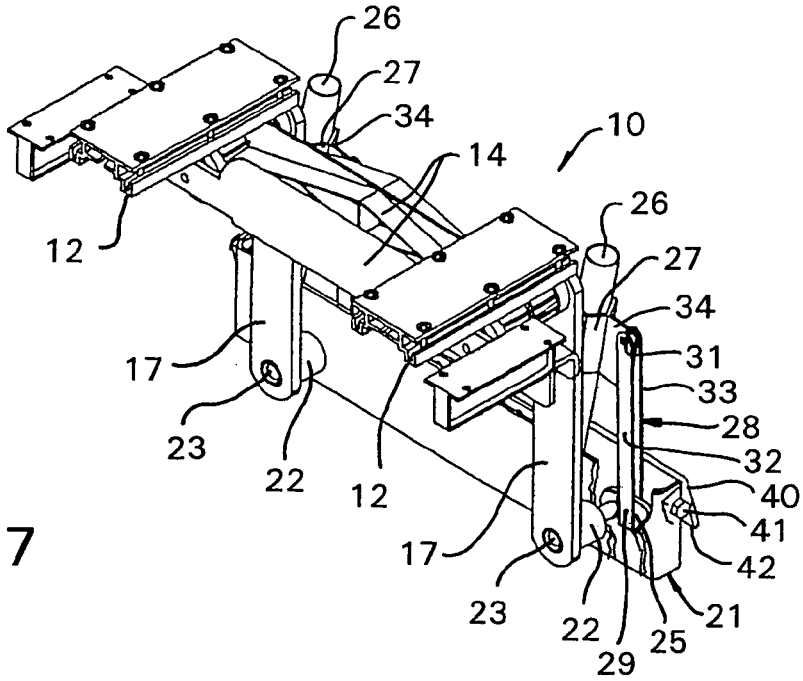
FIG. 7 is a top, rear and right side isometric view corresponding to FIG. 1.
Figure 8:
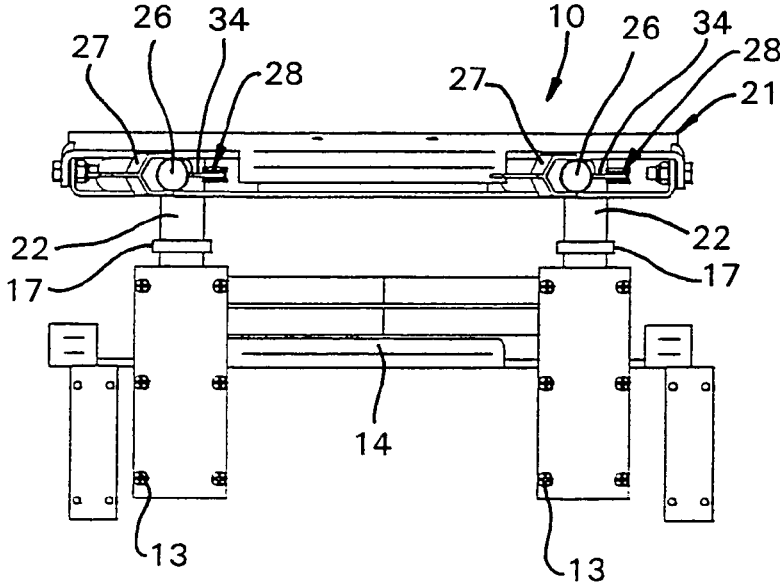
FIG. 8 is a top view of FIG. 7.
Figure 9:
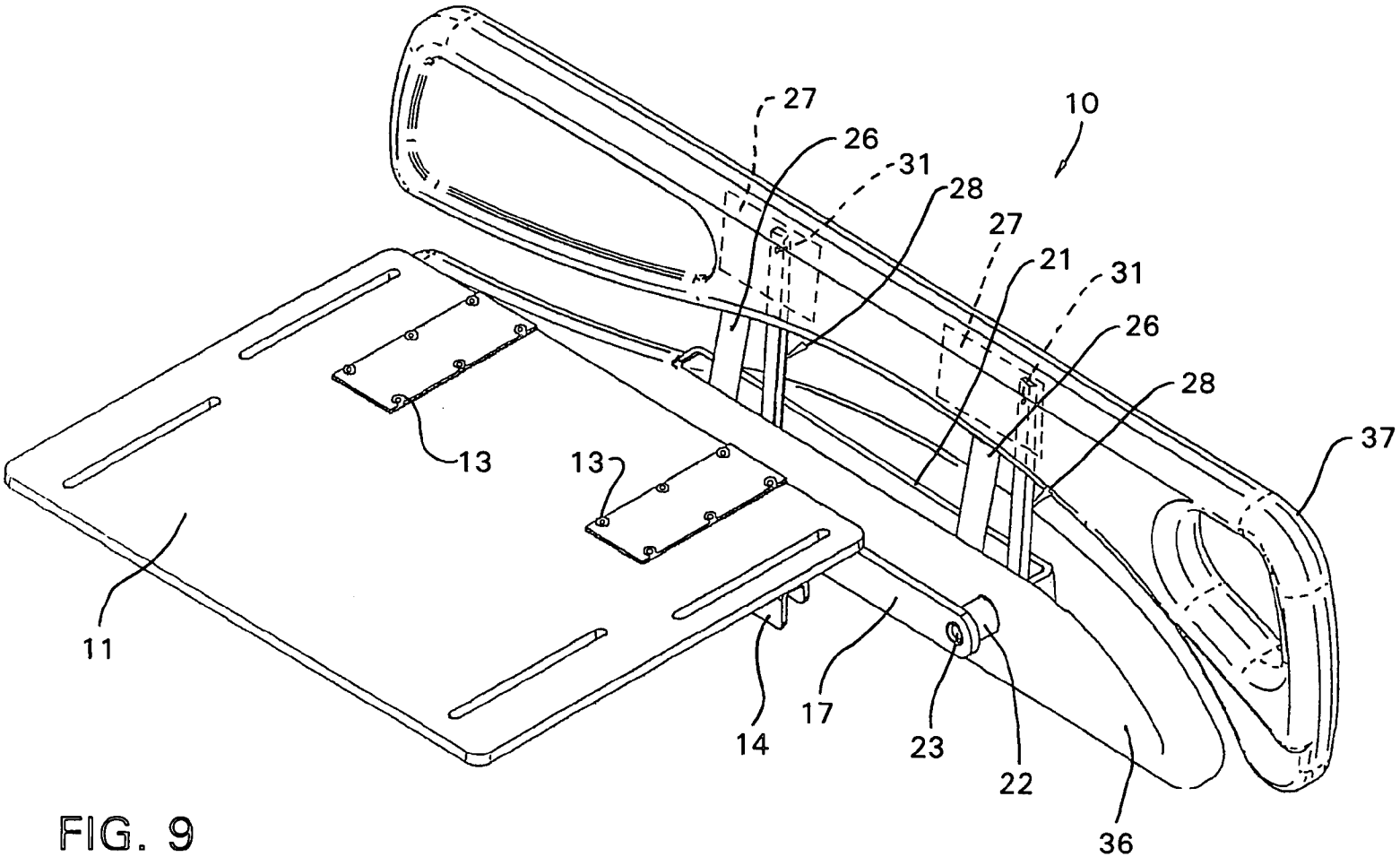
FIG. 9 is a top, rear and right side isometric view of the siderail assembly in a shifted position midway between the stowed position of FIG. 1 and a fully deployed position.
Figure 10:
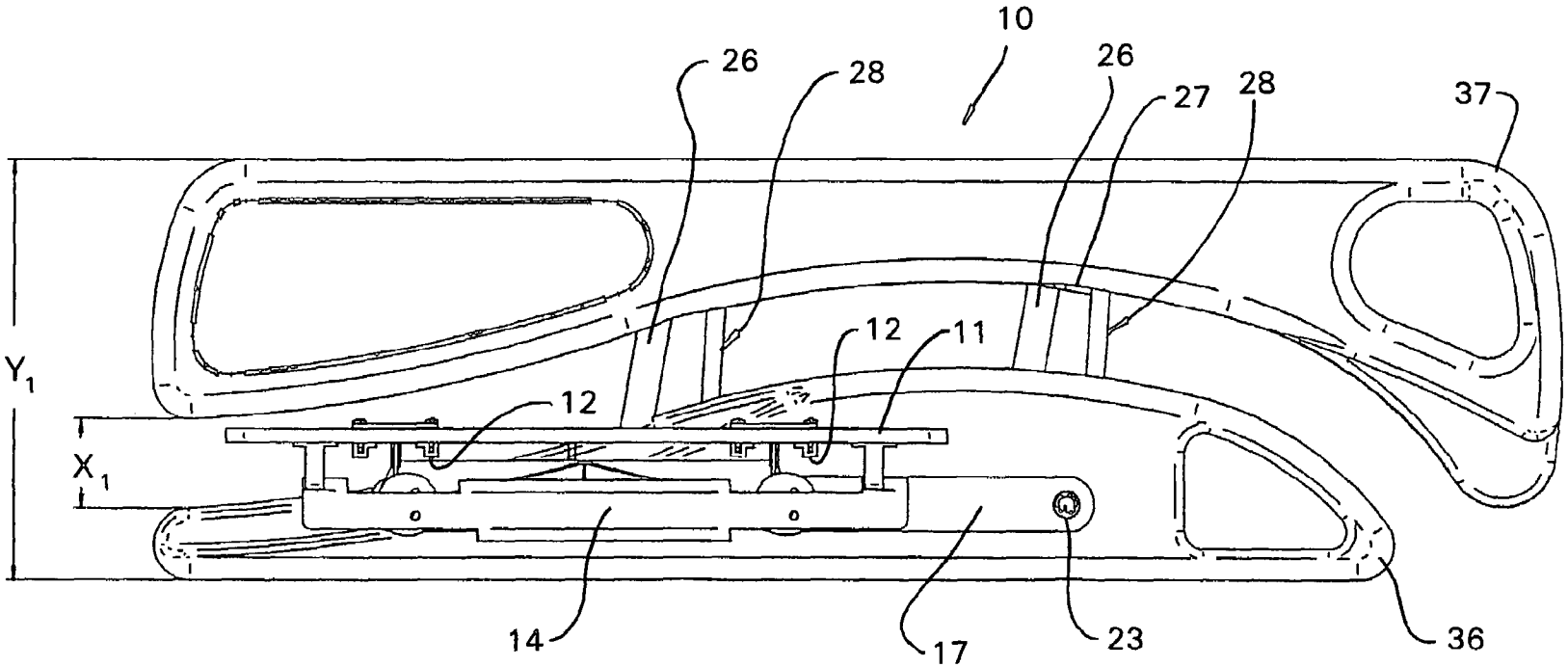
FIG. 10 is a rear view of FIG. 9.
Figure 13:
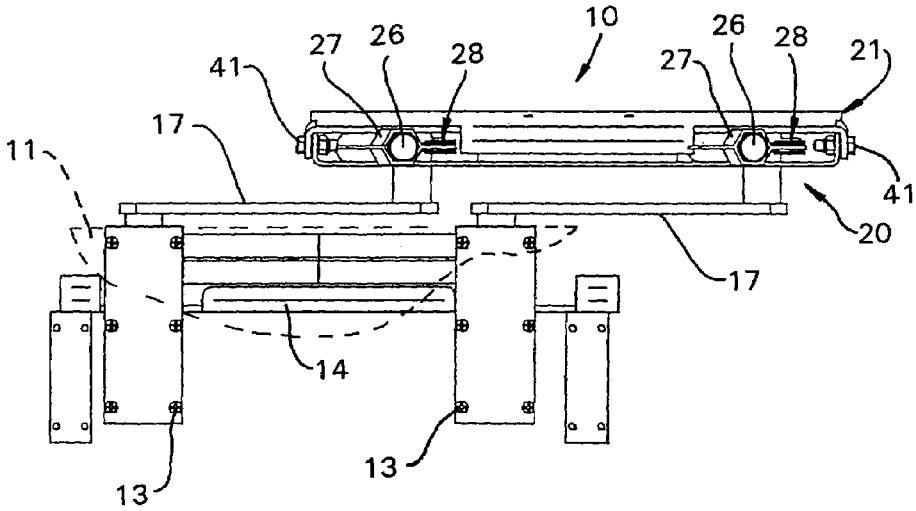
FIG. 13 is a top view of FIG. 11.
Figure 11:
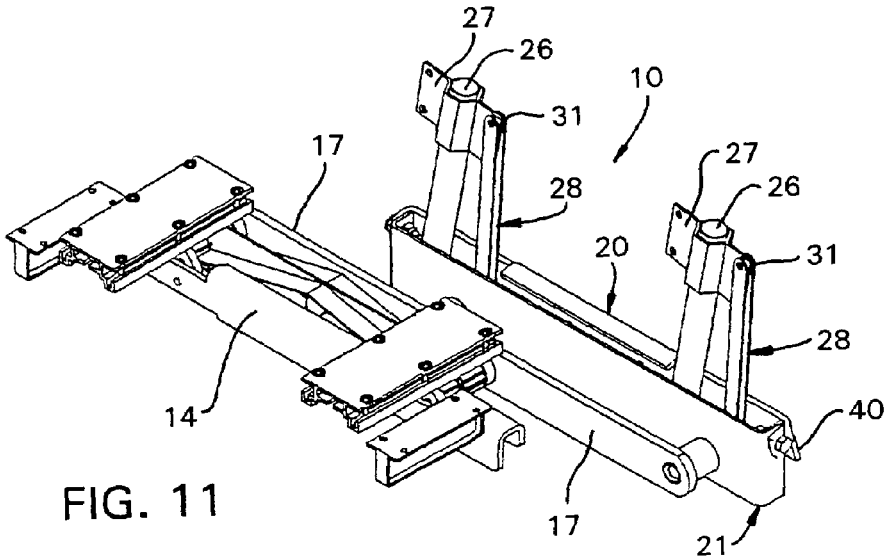
FIG. 11 is a top, rear and right side isometric view of the siderail assembly corresponding to FIG. 9 and with the siderail shroud removed.
Figure 12:
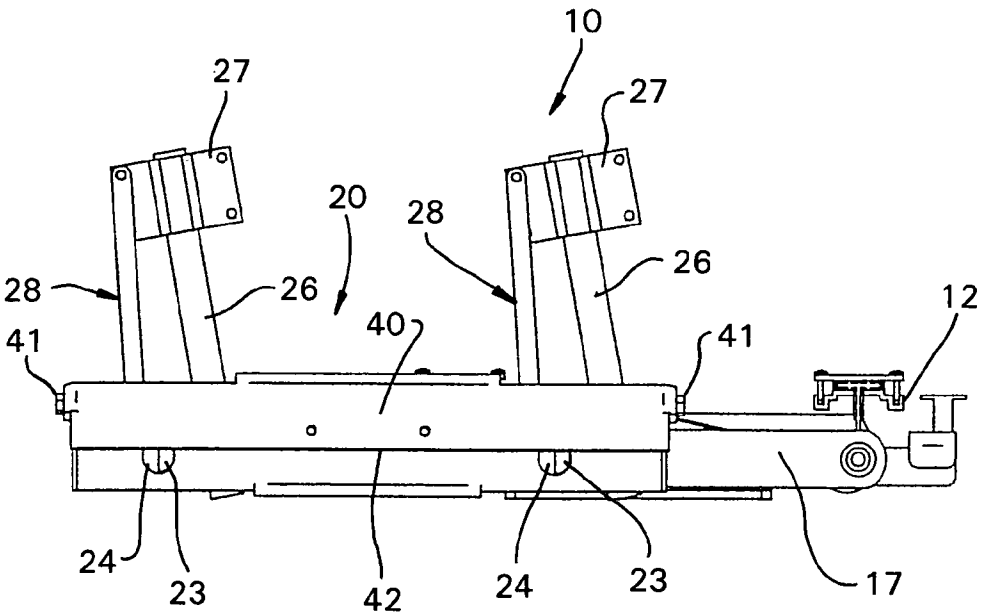
FIG. 12 is a front view of FIG. 11.
Figure 14:
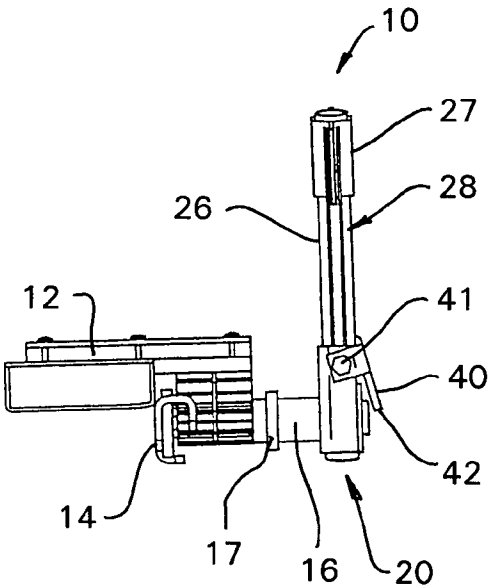
FIG. 14 is a right side view of FIG. 11.

A siderail support frame 20 (FIGS. 5–8) includes a base 21 on which is provided at least one journal 22 extending from the rear side thereof as illustrated in FIG. 5 and incorporates therein structure facilitating a pivotal connection to the distal end of the arm 17. As stated above, and as disclosed herein, a pair of arms 17 are provided and, therefore, the base 21 includes a pair of journals 22 as illustrated in FIGS. 7 and 8 to facilitate a pivotal connection of the distal ends of each of the arms 17 to the base 21. This connection enables the arms 17 to always remain parallel to one another in all pivoted positions thereof as will become readily apparent below. An axle 23 rotatably supported in the bearings housed within the journals 22 is fixedly secured to the respective arms 17. The end of the axle remote from the arm 17 includes a flat surface 24, the flat surfaces being oriented in parallel planes in all positions of the arms 17. The purpose of the flat surfaces 24 will be explained in more detail below.

Figure 6:
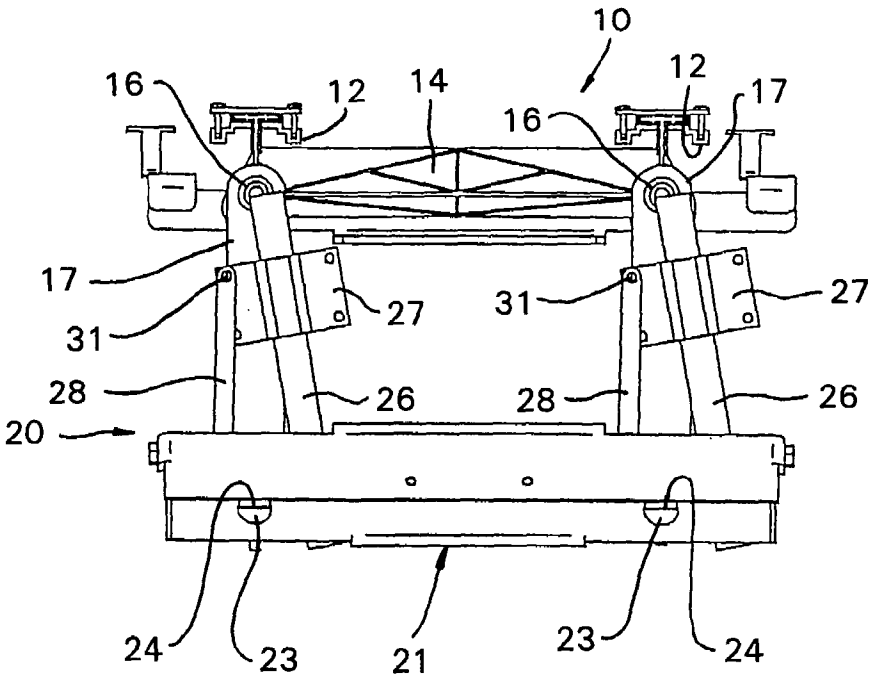
FIG. 6 is a front view of the siderail assembly with the siderail shroud removed.

A pair of parallel extending guide members 26 are fixedly mounted to the siderail support frame 20 and extend upwardly therefrom as illustrated in FIG. 6. In this particular embodiment, the guide members 26 extend parallel to one another and are inclined to the vertical. A carriage 27 is supported for reciprocal movement along the length of the guide members 26.

As is illustrated in FIG. 7, the axle 23 also includes a lever arm 25 fixedly secured thereto and is movable therewith. The purpose of the lever arm 25 will be explained in more detail below.

A link member 28 is pivotally connected to the lever arm 25 as at 29 and to the carriage 27 as at 31. In this particular embodiment, the link member 28 is composed of a pair of parallel extending linkages 32 and 33 that are configured to straddle the lever arm 25 and straddle a flange 34 provided on the carriage 27. A shroud 36 is configured to cover the base frame 21 as illustrated in FIGS. 1 and 2. Similarly, a further shroud 37 is configured to attach to the carriage 27. An initial spacing $X_0$ exists between the two shrouds 36 and 37 as illustrated in FIG. 2 and the initial overall top to bottom dimension of the two shrouds 36 and 37 is indicated as $Y_0$ in FIG. 2. The dimensions $X_0$ and $Y_0$ are to be noted as being associated with the siderail assembly being in the lowered position wherein the upper edge 38 of the shroud 37 is positioned beneath the plate 11 to facilitate stowage of the siderail assembly beneath the substructure supporting the patient support deck.

Figure 22:
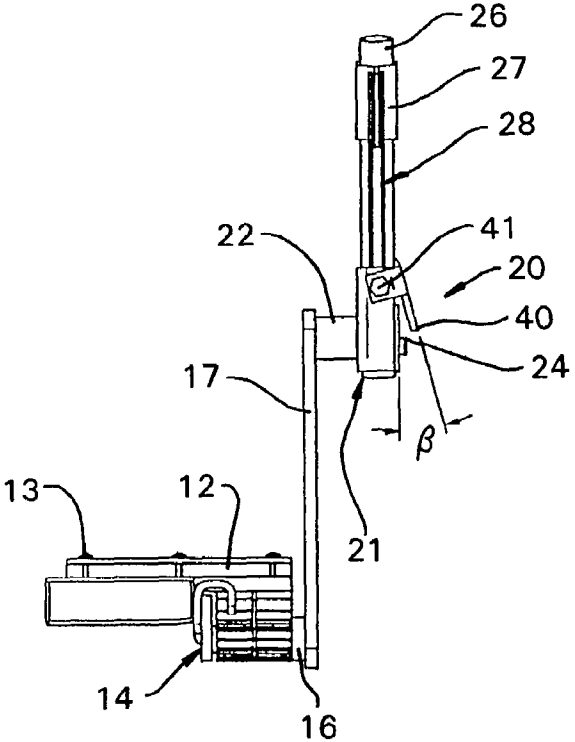
FIG. 22 is a left side view of FIG. 21.

Referring to FIG. 22, the base 21 of the siderail support frame 20 includes an elongate plate 40 hingedly secured at opposite ends thereof and as at 41 to the base 21. The plate 40 overlays a front face of the base 21 with a lower edge 42 being capable of moving into and out of interfering relation with the flat surface 24 on each axle 23. When the plate 40 is pivoted to the angle $\beta$ (FIG. 22) relative to the vertical about the axis of the pivot connection 41, the edge 42 of the plate will be spaced from the flat surfaces 24 to thereby allow the axles 23 to freely rotate. Since the axles 23 are fixedly secured to each of the arms 17, engagement of the edge 42 with the flat surfaces will prevent any pivoting movement of the arms 17 with respect to the carriage 14 and the base 21. Manipulation of the plate 40 will be facilitated by the connection of a handle 43 to the plate 40.

OPERATION

Although the operation of the siderail assembly 10 described above will be understood from the foregoing description by skilled persons, a summary of such description is now given for convenience.

Figure 15:
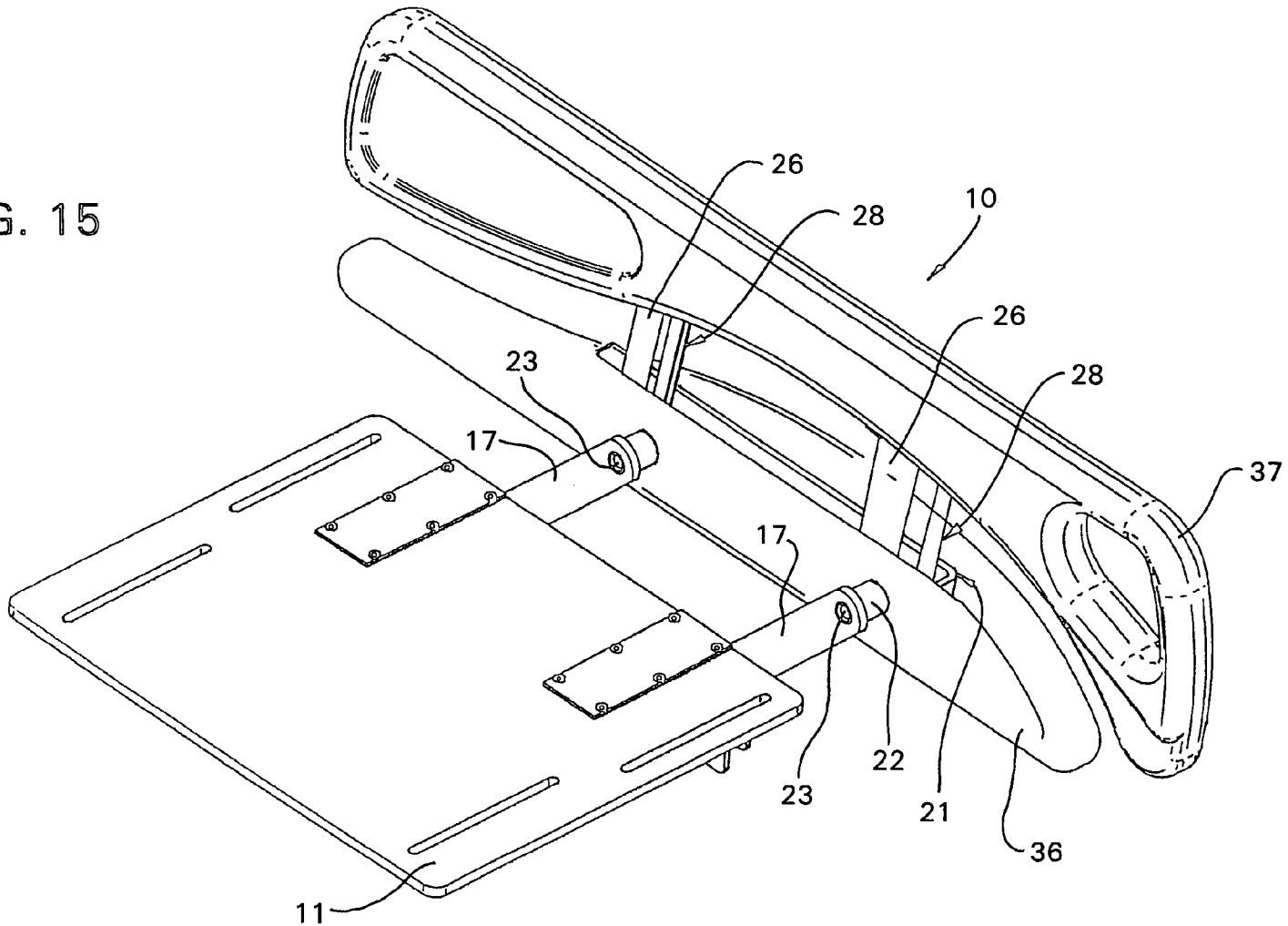
FIG. 15 is a top, rear and right side isometric view of the inventive siderail assembly in a further position thereof between the fully stowed position and the fully deployed position.
Figure 16:
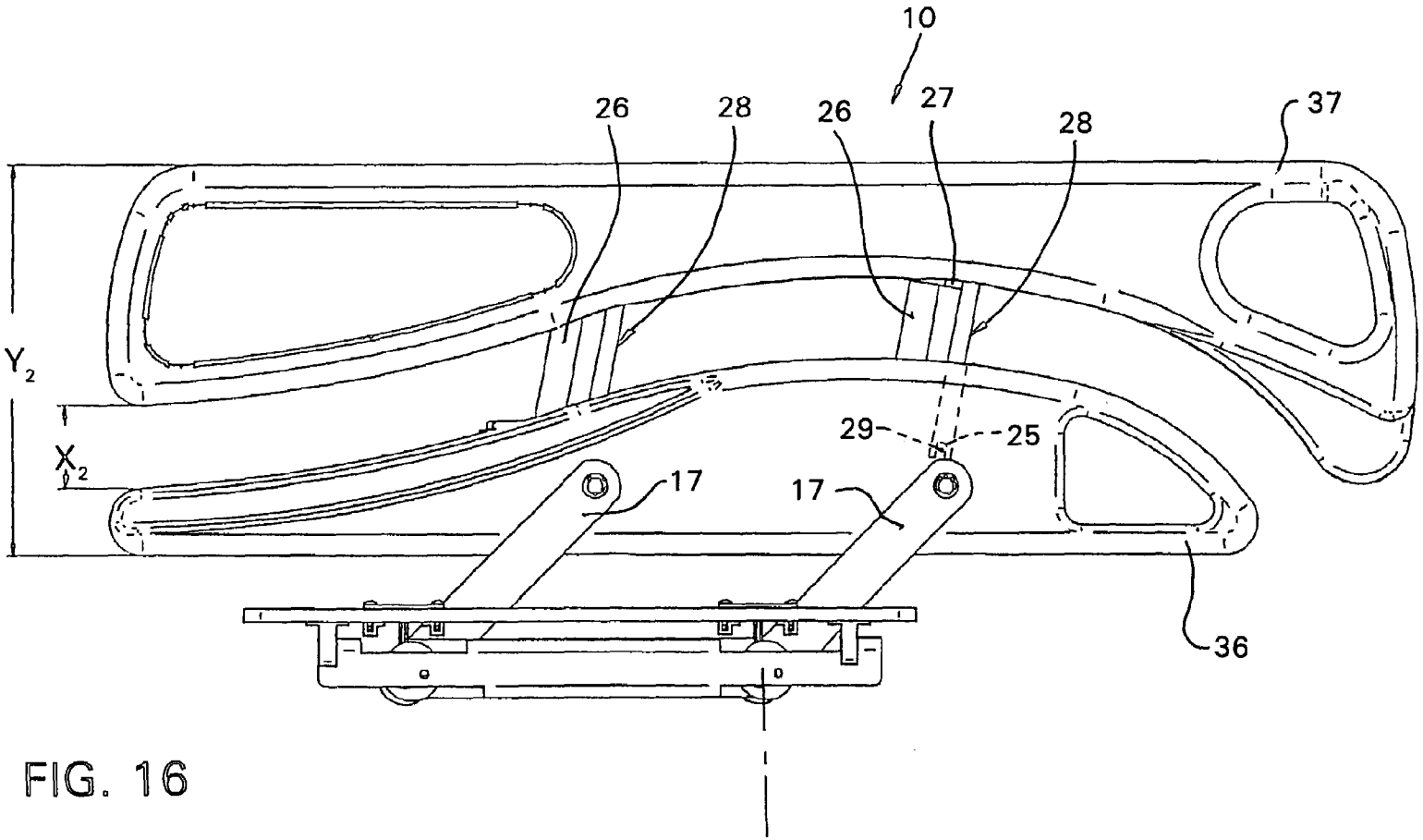
FIG. 16 is a rear view of FIG. 15.
Figure 17:
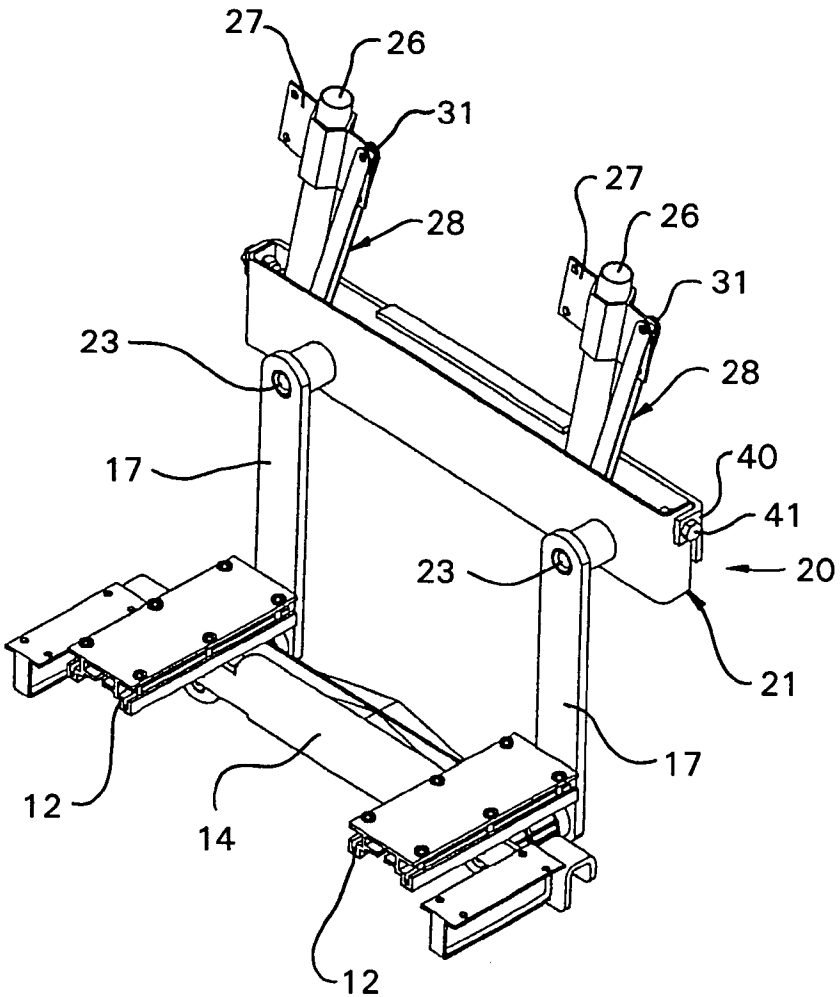
FIG. 17 is a top, rear and right side isometric view of the siderail assembly in a fully deployed position.
Figure 18:
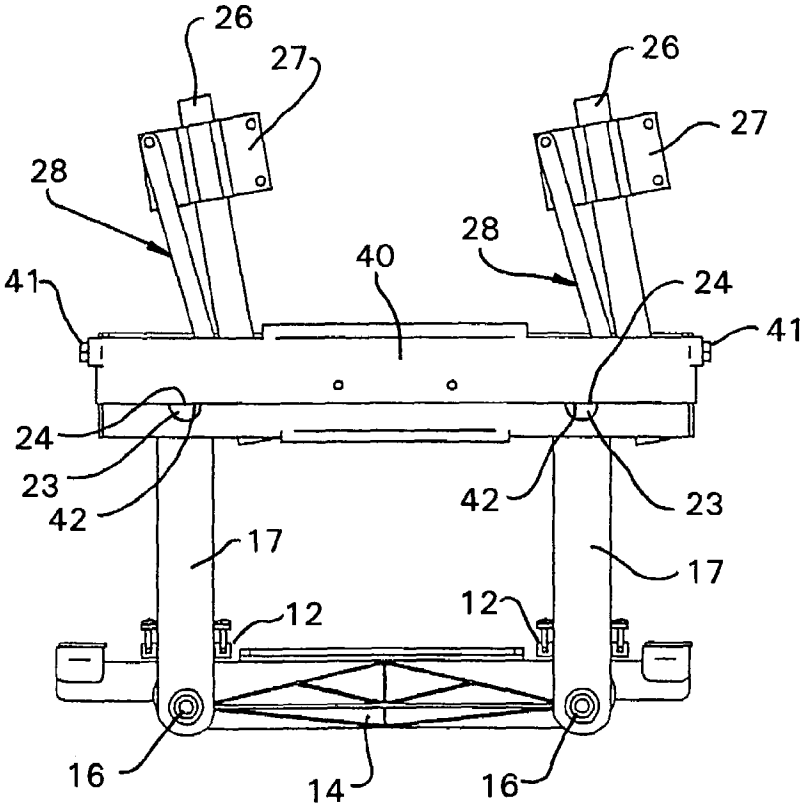
FIG. 18 is a front view of FIG. 17.
Figure 19:
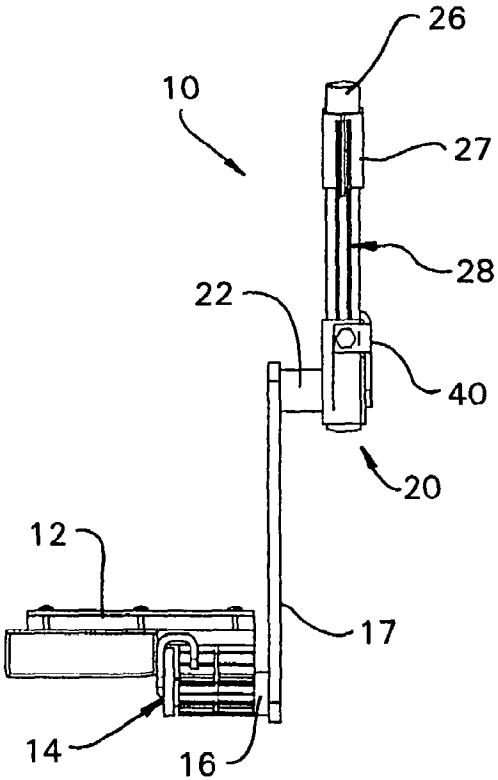
FIG. 19 is a right side view of FIG. 17.
Figure 20:
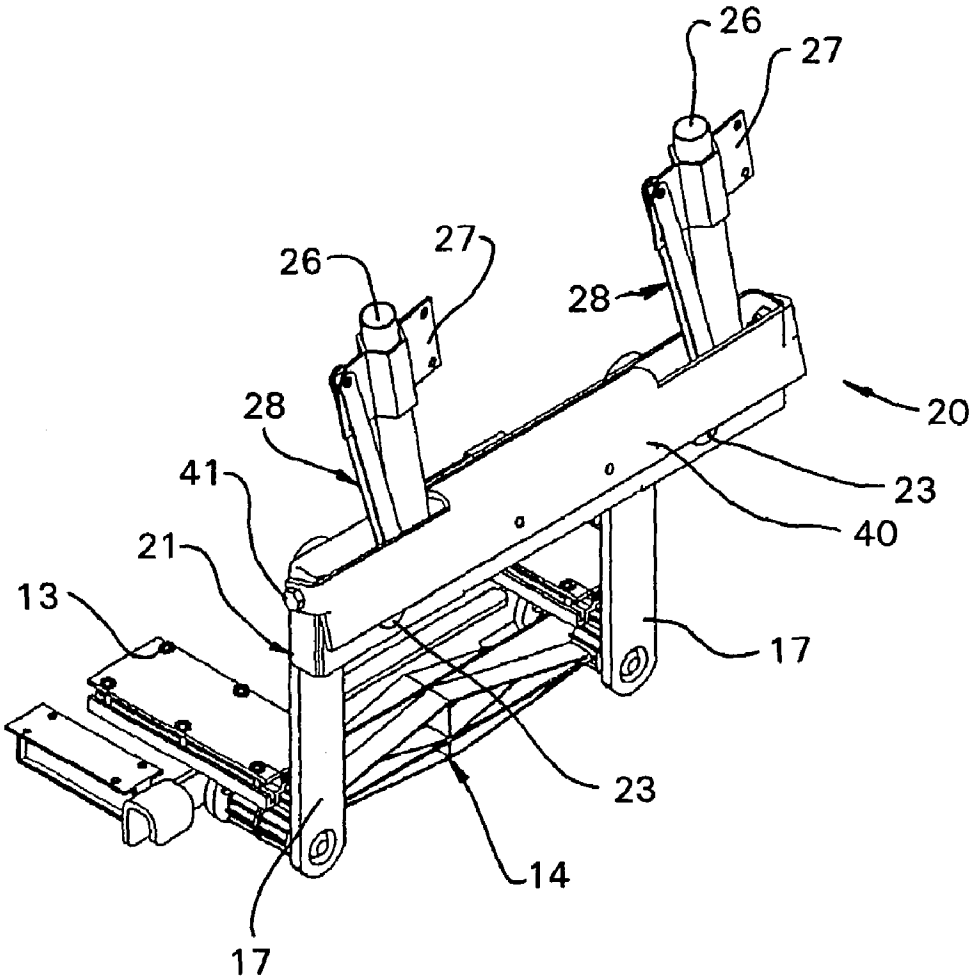
FIG. 20 is a top, front and right side isometric view of the configuration illustrated in FIG. 18.
Figure 21:
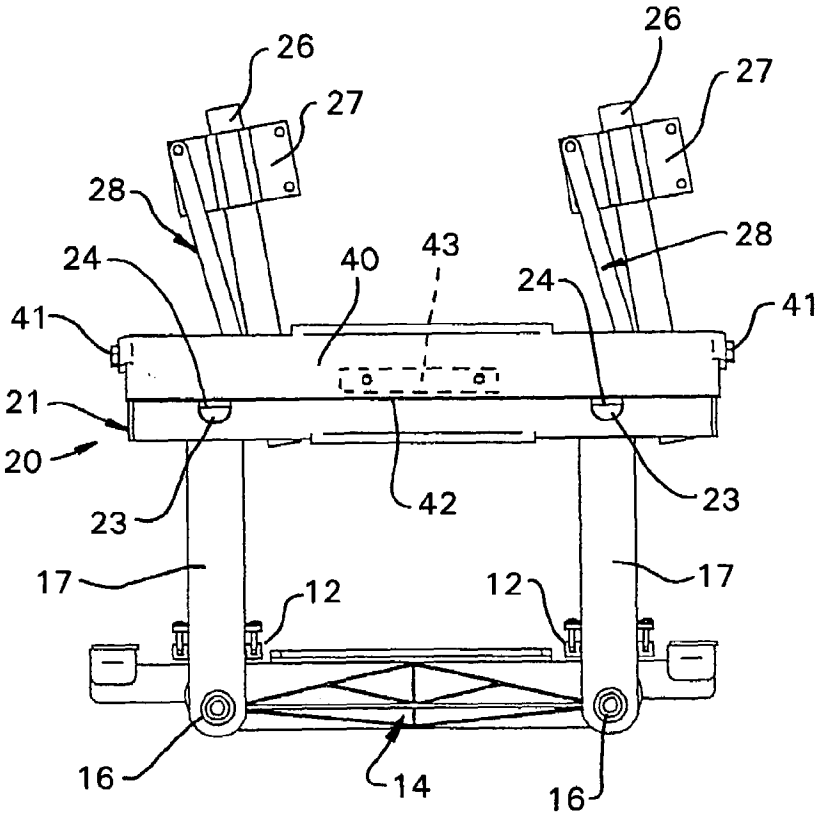
FIG. 21 is a front view of FIG. 20.

For convenience, the following is a brief overview of the content of the drawings. FIGS. 1–8 illustrate the siderail assembly in its lowermost position to facilitate lateral movement of the carriage 12 along the tracks 12 and to facilitate stowage of the assembly beneath the substructure for the patient support deck. FIGS. 9–14 illustrate the siderail assembly positioned alongside of a lateral edge of the patient support deck with the arms 17 having been rotated 90° from the position illustrated in FIGS. 1–8. FIGS. 15–16 illustrate the arms 17 having been pivoted beyond the 90° position to an approximate 135° position compared to the position of the arms in FIGS. 1 to 8. FIGS. 17–22 illustrate the arms 17 in their final fully deployed positions spaced 180° from the position illustrated in FIGS. 1–8.

During the aforesaid pivoting motion of the arms 17, it is assumed that the plate 40 has been lifted and pivoted to the position illustrated in FIG. 22 so that the downwardly facing edge 42 is spaced from an interfering relation with the flat surfaces 24 on the axles 23. Since the axles 23 are fixed to the arms 17, the lifting force applied by one hand of the attendant to the handle 43 (FIG. 21) will cause the lever arms 25 (FIG. 7) to effectively travel with the axles as the arms pivot to effect a raising of the link members 28 in the vertical direction to in turn cause the carriages 27 to move upwardly relative to the guide members 26. It will be noted in FIG. 10, when comparing same to FIG. 2, that the spacing between the two shrouds 36 and 37 has increased to the dimension $X_1$ whereas the overall top to bottom dimension of the two shrouds 36 and 37 has increased to the dimension $Y_1$. The dimensions $X_1$ and $Y_1$ correspond to the arms 17 being in the 90° position as illustrated in FIGS. 10–14. A continued movement of the lever arms 17 to the 135° position illustrated in FIGS. 15 and 16 will orient the lever arm 25 to a vertically upright extending position representing the highest position of the carriage 27 and thence the shroud 37 secured thereto. This is due to the lever arms 25 extending vertically in this position as shown in FIG. 16. The dimension $X_2$ has increased beyond the previously mentioned dimension $X_1$ and the top to bottom dimension of the two shrouds 36 and 37 has increased to the dimension $Y_2$ which is greater than the previous dimension of $Y_1$. $X_2$ and $Y_2$ are the largest dimensions herein described.

Continued movement of the arms 17 to the 180° position illustrated in FIGS. 17–22 will cause the lever arms 25 to move counterclockwise from the position illustrated in FIG. 16 to an approximate 45° orientation relative to the vertical so as to reduce the dimension between the two shrouds 36 and 37 a small amount as well as reducing the top to bottom dimension of the two shrouds 36 and 37 also by a small amount. If desired, the lever arms 25 could be restructured so as to be essentially an elongate extension of the lever arm 17 so that when the lever arms 17 are in the vertically upright position illustrated in FIGS. 17–22, the lever arms 25 will extend upwardly therefrom thereby causing the dimension between the two shrouds to increase beyond the $X_2$ dimension previously described and the overall top to bottom dimension of the shrouds 36 and 37 to also increase beyond the aforementioned dimension $Y_2$. However, it has been discovered that an orienting of a longitudinal axis of the lever arms 25 at about a 35° to 55° angle, preferably at a 45° angle, relative to the longitudinal axis of the respective arm 17 provides the appropriate leverage to facilitate the aforesaid movements.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A siderail assembly for a bed, comprising:

a frame;

at least one arm pivotally supported on said frame for movement between first and second positions, said at least one arm having at a distal end thereof a first connection location;

a siderail support frame pivotally connected to said distal end of said arm, said siderail support frame having at least one upstanding and elongate guide member thereon;

a siderail carriage frame supported for movement along a length of said guide member toward and away from said siderail support frame and having at least one second connection location thereon;

at least one elongate link pivotally connected to and extending between said first and second connection locations and to effect movement of said siderail carriage frame along said guide member toward and away from said siderail support frame in response to a pivotal movement of said arm relative to said frame to change the spacing between said siderail carriage frame and said siderail support frame.

2. The siderail assembly according to claim 1, wherein said at least one arm includes two laterally spaced arms that are each pivotally supported on said frame and extend parallel to each other.

3. The siderail assembly according to claim 2, wherein said first connection location is provided at said distal ends of each of said two arms, said at least one second connection location on said siderail carriage frame including two laterally spaced second connection locations thereon, said at least one elongate link including two links each respectively pivotally connected to and extending between said first and second connection locations.

4. The siderail assembly according to claim 1, wherein said siderail carriage frame includes a latching mechanism for releasably locking said siderail carriage frame to said at least one arm when said at least one arm is at said first position.

5. The siderail assembly according to claim 4, wherein said latching mechanism includes a handle supported on said siderail support frame for movement between said first and second positions thereof, said pivotal connection of said distal end of said arm to said siderail support frame including an axle fixed to said arm and having a flat section thereon, said handle being configured to interface with said flat section when said handle is in a first position thereof to prevent said arm from moving relative to said siderail support frame and free of said interfacing relation when said handle is in a second position thereof to facilitate movement of said arm relative to said siderail support frame.

* * * * *